US007537213B2

(12) United States Patent
Chang et al.

(10) Patent No.: US 7,537,213 B2
(45) Date of Patent: May 26, 2009

(54) INDIVIDUAL SHEET MEMBER OUTPUT CONTROL METHOD

(75) Inventors: Hung-Yi Chang, Chilung (TW); Chih-Ching Liao, Yunlin Hsien (TW)

(73) Assignee: International Currency Technologies Corp., Taipei (TW)

( * ) Notice: Subject to any disclaimer, the term of this patent is extended or adjusted under 35 U.S.C. 154(b) by 224 days.

(21) Appl. No.: 11/534,211

(22) Filed: Sep. 21, 2006

(65) Prior Publication Data

US 2008/0073834 A1 Mar. 27, 2008

(51) Int. Cl.
*B65H 7/12* (2006.01)

(52) U.S. Cl. ..... 271/262; 271/10.02; 271/10.03; 271/902; 271/263; 271/265.04; 271/110

(58) Field of Classification Search ..... 271/262, 271/10.02, 10.03, 902, 225, 263, 265.04, 271/110, 122, 125
See application file for complete search history.

(56) References Cited

U.S. PATENT DOCUMENTS 4,560,293 A * 12/1985 McCumber et al. ..... 400/61
5,125,642 A * 6/1992 Orsinger et al. ..... 271/262
5,384,631 A * 1/1995 Matsunami ..... 399/370
5,447,240 A * 9/1995 Makino ..... 209/576
5,529,298 A * 6/1996 Gough et al. ..... 271/9.09
5,586,755 A * 12/1996 Hansen ..... 271/9.06
5,599,011 A * 2/1997 Schnorr et al. ..... 271/10.11
6,290,070 B1 * 9/2001 Graef et al. ..... 209/534
6,540,222 B2 * 4/2003 Araki et al. ..... 271/122
6,554,275 B1 * 4/2003 Tranquilla ..... 271/259
6,588,740 B2 * 7/2003 Brugger et al. ..... 271/10.03
6,889,972 B2 * 5/2005 Chang ..... 271/23
7,140,607 B2 * 11/2006 Graef et al. ..... 271/122
7,427,061 B2 * 9/2008 Ruthenberg et al. ..... 271/122
2004/0080094 A1 * 4/2004 Dopfer ..... 271/122
2004/0212142 A1 * 10/2004 Graef et al. ..... 271/121

* cited by examiner

*Primary Examiner*—Patrick H Mackey
*Assistant Examiner*—Prasad V Gokhale
(74) *Attorney, Agent, or Firm*—Bacon & Thomas, PLLC.

(57) ABSTRACT

An individual sheet member output control method used in a sheet member dispenser to control reversing of a transferring roller set for a secondary dispensing by a dispensing roller set when a sensor detected delivery of overlapped sheet members toward a sheet member outlet. The reversing and re-dispensing procedure is repeated to have overlapped sheet members be separated, and the transferring roller set is reversed to move overlapped sheet members backwards and then the machine is shut down for examination if overlapped sheet members still cannot be separated after the reversing and re-dispensing procedure has been repeated a predetermined number of times.

5 Claims, 11 Drawing Sheets

INDIVIDUAL SHEET MEMBER OUTPUT CONTROL METHOD

BACKGROUND OF THE INVENTION

1. Field of the Invention

The present invention relates to an individual sheet member output control method used in a sheet member dispenser and more particularly, to such an individual sheet member output control method, which return dispensing sheet members that are detected overlapped and dispense the returned sheet members again, preventing shutdown of the machine due to a false judgment.

2. Description of the Related Art

Following fast development of technology, our mode of living has been changed. Various automatic vending machines (ticket venders, coin exchanging machines, etc.) are used everywhere to sell different products without serviceman. These automatic vending machines save much labor and bring convenience to people. An automatic vending machine may be quipped with a sheet member dispenser to dispense sheet members (cards, tickets, coupons, banknotes, etc.). However, due to thin thickness of sheet members, two or more sheet members may be overlapped or stacked when they are delivered toward the sheet member outlet. Manufacturers are trying hard to design sheet member dispensers that can dispense sheet members smoothly and individually.

FIG. 11 is a schematic side view of a sheet member dispenser according to the prior art. As illustrated, the sheet member dispenser A comprises an accommodation chamber A1, a gap adjustment device B disposed at the front side of the accommodation chamber A1, a plurality of sheet transferring rollers A2 disposed beneath the accommodation chamber A1, a motor A3 controlled to rotate the sheet transferring rollers A2 and to transfer sheet members (for example, banknotes) C out of the accommodation chamber A1 to the sheet member path defined by the gap adjustment device B. According to this design, the circumferential length of the sheet transferring rollers A2 is shorter than the length of the sheet members C, and the sheet transferring rollers A2 are molded from a material having a high friction force, for example, rubber. Therefore, the transferring rollers A2 keep transferring sheet members C forwards when rotated. To control dispensing of one single sheet member C at a time, the ratio between the circumferential length of the transferring rollers A2 and the length of the sheet members C must be measured and then transferring rollers A2 are rotated through an angle corresponding to the length of one single sheet member C. However, this limitation does not allow the sheet member dispenser to dispense different sizes of sheet members. Further, the transferring roller A2 transfer sheet members C by means of a friction force. However, sheet members C may be adhered together due to the effect of static electricity, water content, burrs, or ink. Further, due to precision reason, the gap adjustment device B may be not able to adjust the gap of the sheet member path to fit the thickness of one single sheet member C perfectly. In this case, two overlapped or stacked sheet members C may be dispensed. If the gap of the sheet member path adjustment device B allows only one single sheet member C to pass, a second sheet member C may be jammed in the gap adjustment device B or in between the gap adjustment device B and the accommodation chamber A1 when a first sheet member C of two overlapped sheet members C is moved through the sheet member path, resulting in damage of the sheet member dispenser A.

Therefore, it is desirable to provide an individual sheet member output control method for sheet member dispenser that eliminates the aforesaid problems.

SUMMARY OF THE INVENTION

The present invention has been accomplished under the circumstances in view. According to one embodiment of the present invention, the individual sheet member output control method is used in a sheet member dispenser comprising a housing, which accommodates a stack of sheet members and has a sheet member outlet and a sheet member path for guiding the sheet members to the sheet member outlet, a transferring roller set adapted to transfer sheet members forwards to the sheet member path, a dispensing roller set disposed at a top side of the sheet member path and adapted to dispense sheet members from the transferring roller set to the sheet member outlet, and sensor means provided between the dispensing roller set and the sheet member outlet. The individual sheet member output control method comprises the steps of (a) the sensor means judges whether or not overlapped sheet members been dispensed?; (b) reverse the transferring roller set to move the dispensed sheet members backwards when the sensor means judged that overlapped sheet members had been dispensed; (c) rotate the transferring roller set forwards again to move sheet members forwards for dispensing by the dispensing roller set again; (d) repeat step (e) and step (c) again; and (e) reverse the transferring roller set to move the dispensed sheet members backwards and shut down the sheet member dispenser after step (b) and step (c) have been repeated a predetermined number of times. According to a second embodiment of the present invention, the individual sheet member output control method comprises the steps of (a) the sensor means judges whether or not overlapped sheet members been dispensed?; (b) reverse the transferring roller set to move the dispensed sheet members backwards when the sensor means judged that overlapped sheet members had been dispensed, and then rotate the dispensing roller set forwards to dispense the returned the dispensed overlapped sheet members; (c) reverse the transferring roller set to move the overlapped sheet members backwards again if the overlapped sheet members are not separated after a secondary dispensing by the dispensing roller set, and then rotate the dispensing roller set forwards to dispense the returned the dispensed overlapped sheet members again; (d) reverse the transferring roller set to move the overlapped sheet members backwards and shut down the sheet member dispenser after step (c) has been repeated a predetermined number of times; and (e) keep rotating the transferring roller set forwards to deliver the overlapped sheet members toward the sheet member outlet if the overlapped area of overlapped sheet members is below a predetermined value, and then reverse the transferring roller set to move the second sheet member backwards after the first sheet member has been moved out of the sheet member outlet.

DETAILED DESCRIPTION OF THE PREFERRED EMBODIMENT

Figure 1:
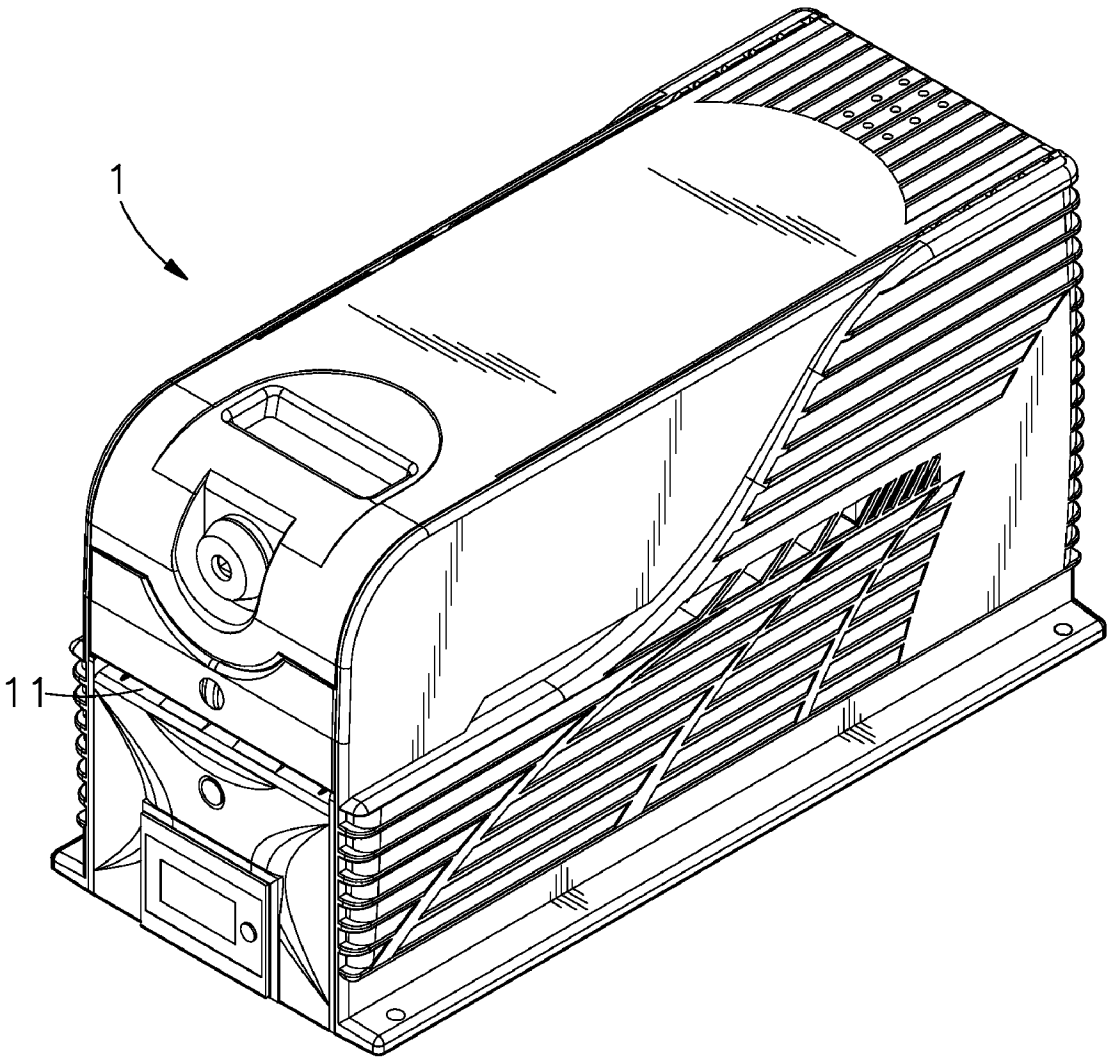
FIG. 1 is an elevational view showing the outer appearance of a sheet member dispenser according to the present invention.
Figure 2:
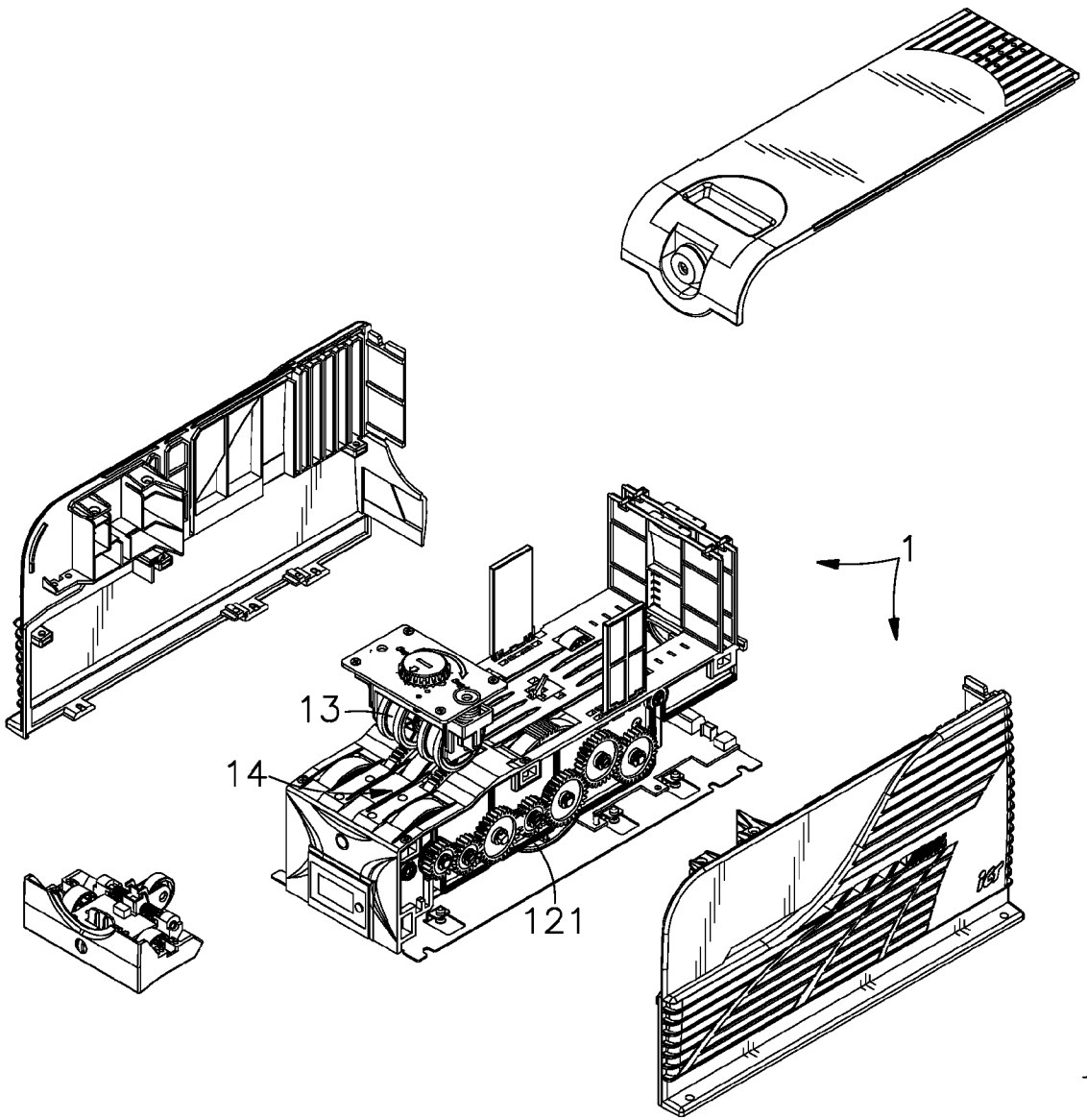
FIG. 2 is an exploded view of the sheet member dispenser shown in FIG. 1.
Figure 3:
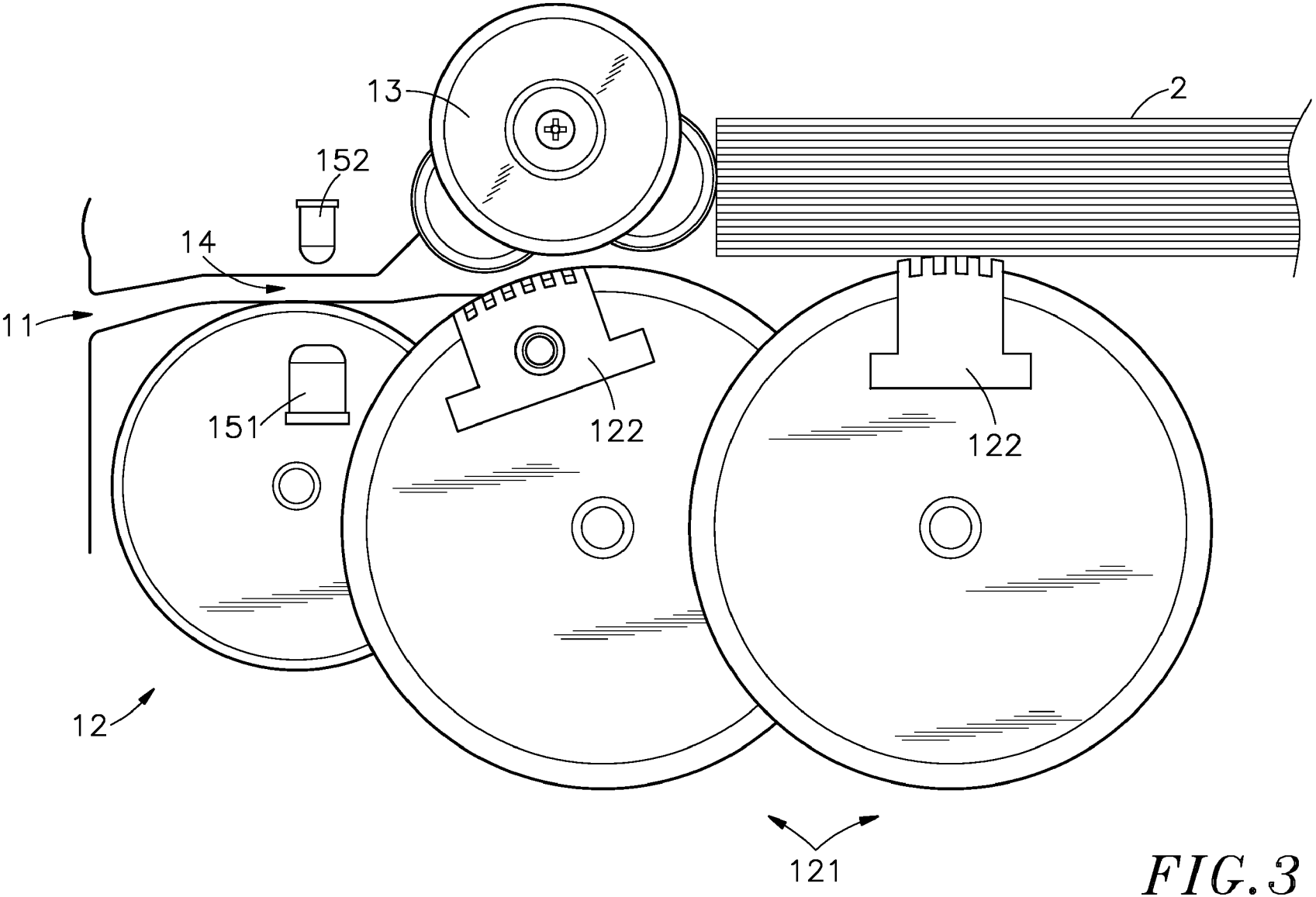
FIG. 3 is a schematic side view in an enlarged scale of a part of the sheet member dispenser according to the present invention.

Referring to FIGS. 1~3, a stack of sheet members 2 is accommodated in a housing 1, and a transferring roller set 12 is mounted inside the housing 1 and controlled to transfer the bottom sheet member 2 to a sheet member outlet 11 on the front side of the housing 1. The sheet members 2 according to this embodiment are banknotes. The housing 1 has a sheet member path 14 defined on the inside for guiding sheet members 2 individually to the sheet member outlet 11. The transferring roller set 12 is comprised of a number of transferring rollers 121. Some transferring rollers 121 are respectively provided with a push block 122 that enhances the friction to the sheet member 2. A dispensing roller set 13 is provided above the sheet member path 14. A sensor 15 is mounted inside the housing 1 between the sheet member outlet 11 and the dispensing roller set 13 and adapted to detect the transmittance of the sheet member 2 being delivered through the sheet member path 14.

The sensor 15 comprises a light-emitting module 151 and a light-receiving module 152. The light-emitting module 151 and the light-receiving module 152 are respectively provided at two sides of the sheet member path 14 and aimed at each other. The light-emitting module 151 emits light across the sheet member path 14. The light-receiving module 152 receives light passing from the light-emitting module 151 across the sheet member path 14, and compares it to a reference value.

Figure 4:
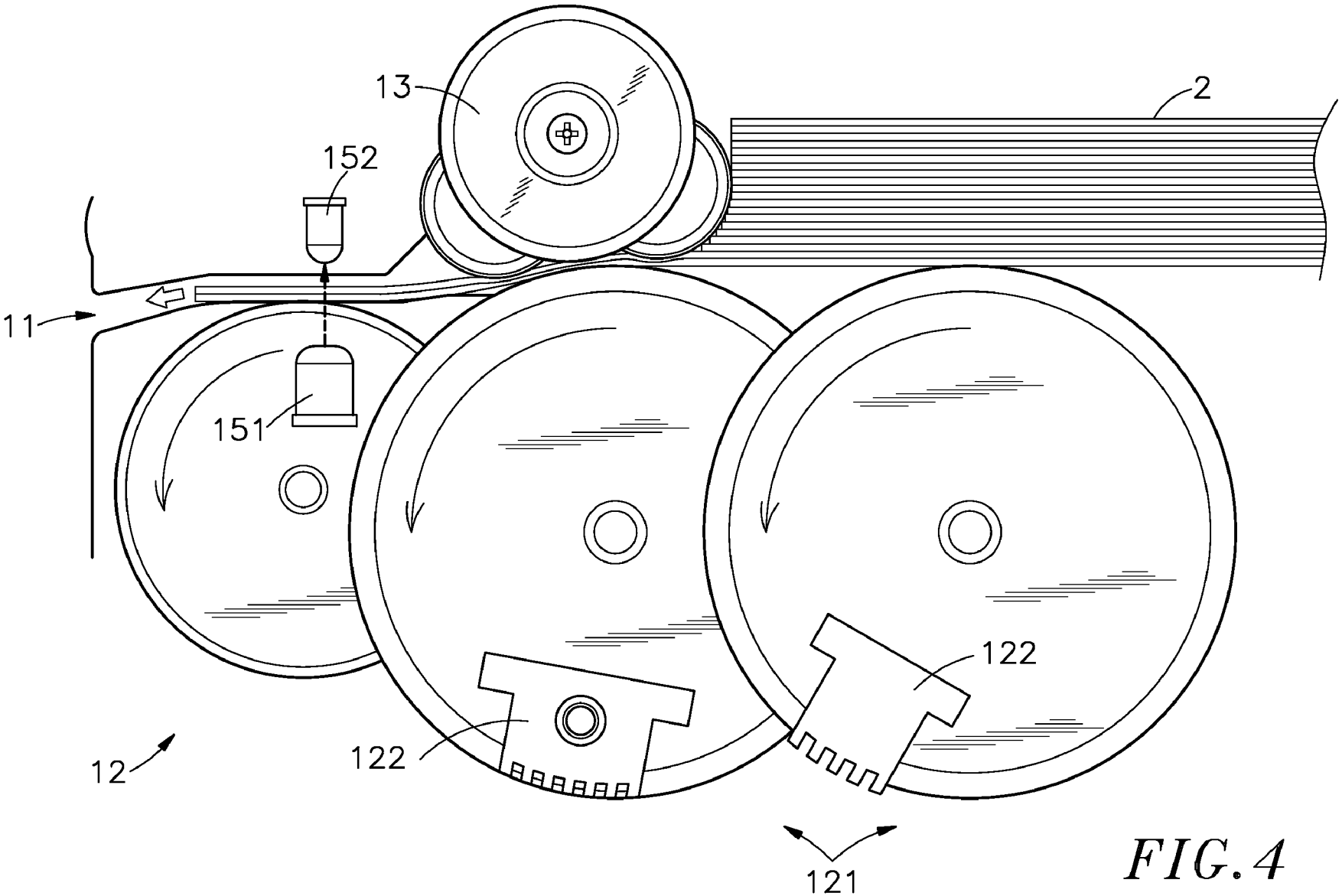
FIG. 4 is a schematic drawing showing the operation of the sheet member dispenser according to the present invention (I).
Figure 5:
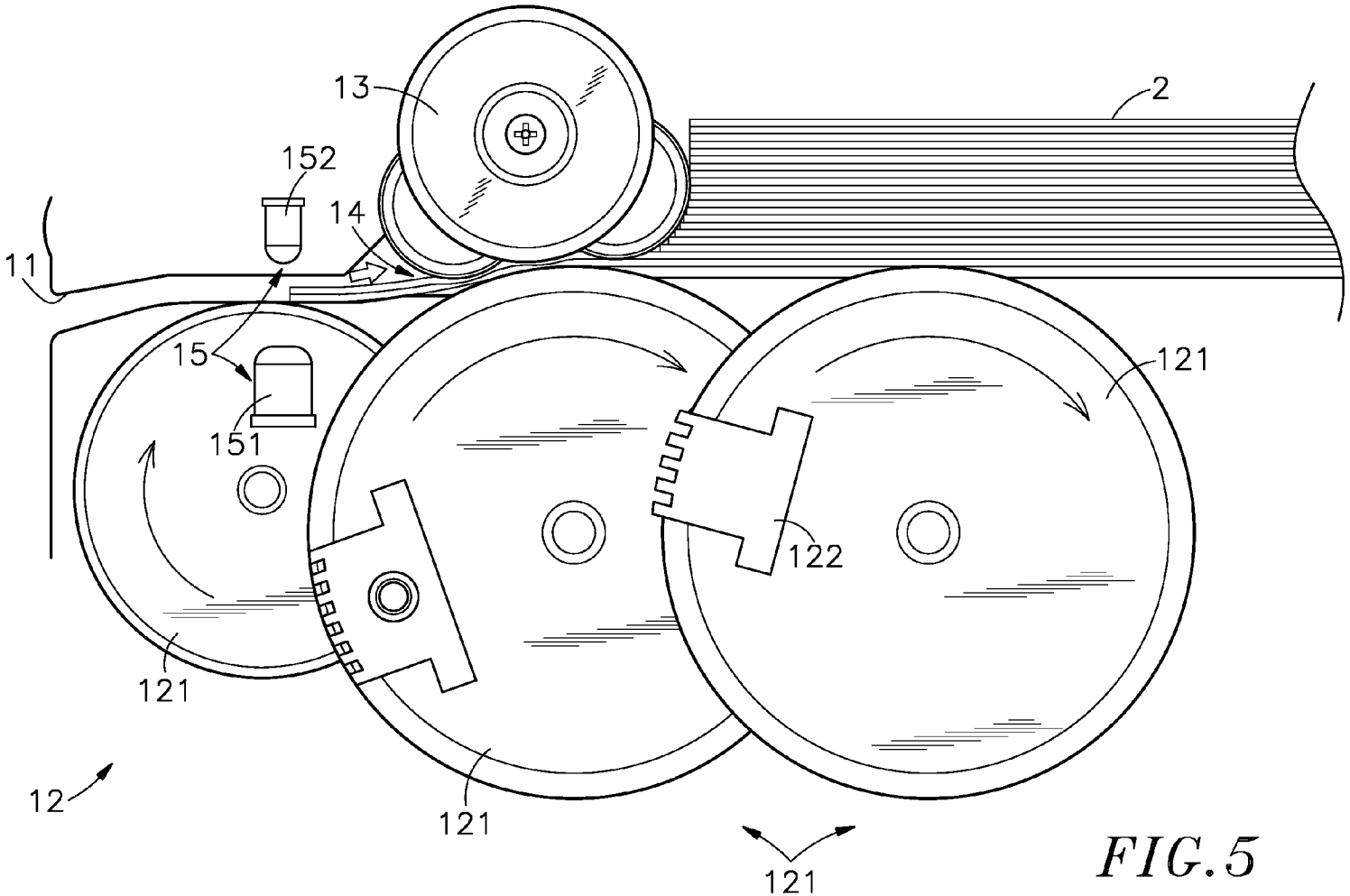
FIG. 5 is a schematic drawing showing the operation of the sheet member dispenser according to the present invention (II).
Figure 6:
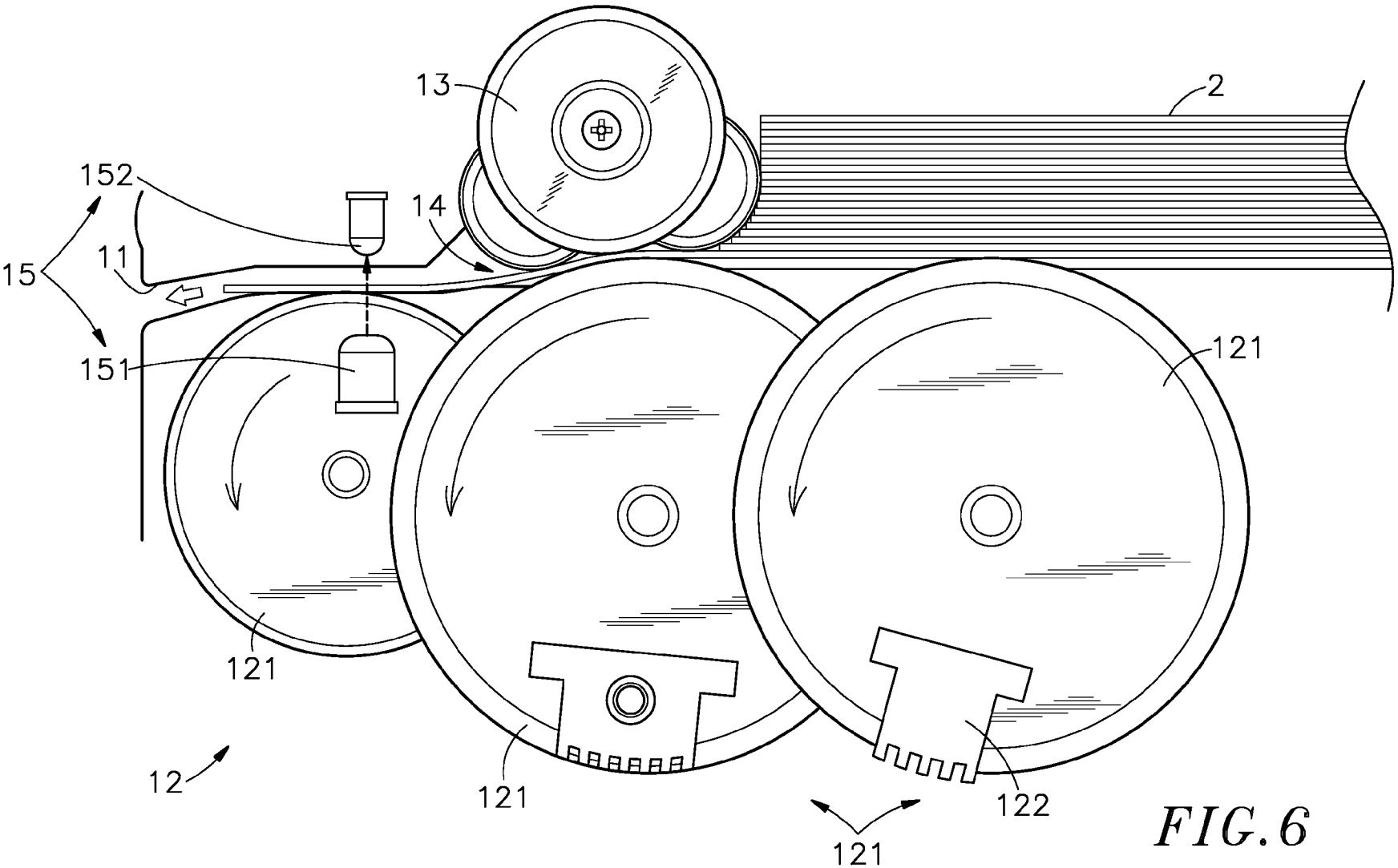
FIG. 6 is a schematic drawing showing the operation of the sheet member dispenser according to the present invention (III).

Referring to FIGS. 4~6, when dispensing the accommodated sheet members 2, the transferring roller set 12 is rotated forwards. At this time, the push blocks 122 are moved with the respective transferring rollers 121 to push a number of the sheet members 2 out of the bottom side of the accommodated stack of sheet members 2 to the dispensing roller set 13 toward the sheet member outlet 11. When a certain number of the sheet members 2 reached the dispensing roller set 13, the dispensing roller set 13 push the sheet members 2 into a stepped manner and carry the lowest sheet member 2 into the sheet member path 14 between the dispensing roller set 13 and the transferring roller set 12 toward the sheet member outlet 11.

In case two stacked sheet members 2 are pushed into the sheet member path 14 toward the sheet member outlet 11 by the dispensing roller set 13 by a mistake, the stacked sheet members 2 go through the sensor 15 (see FIG. 4), and the sensor 15 judges whether or not stacked sheet members 2 are dispensed. At this time, the light-emitting module 151 emits light through the sheet member(s) 2 passing through the sheet member path 14, and the light-receiving module 152 receives the light that passes through the sheet member(s) 2 for counting the transmittance of the sheet member(s) 2. If the transmittance of the sheet member(s) 2 surpasses a predetermined value, it is judged that stacked sheet members are dispensed. At this time, the transferring roller set 12 is reversed to move the stacked sheet members 2 backwards (see FIG. 5) to the front side of the dispensing roller set 13, and then the transferring roller set 12 is rotated forwards to transfer the sheet members 2 again, enabling the dispensing roller set 13 to dispense the sheet members 2 individually (see FIG. 6), and therefore no stacked sheet members will be delivered to the sheet member outlet 11.

Further, if stacked sheet members 2 still cannot be separated during the aforesaid secondary dispensing procedure, the sheet member dispenser will repeat the aforesaid secondary dispensing procedure to move stacked sheet members backwards and then dispense the sheet members again. This secondary dispensing procedure may be repeated several times subject to the setting made by the user. If stacked sheet members still cannot be separated after the secondary dispensing procedure has been performed again and again subject to the setting made by the user, the transferring roller set 12 will move the stacked sheet members 2 backwards and then the sheet member dispenser will be shut down, waiting for the maintenance engineer to check the sheet member dispenser. This design prevents shutdown of the machine due to a false judgment.

Figure 7:
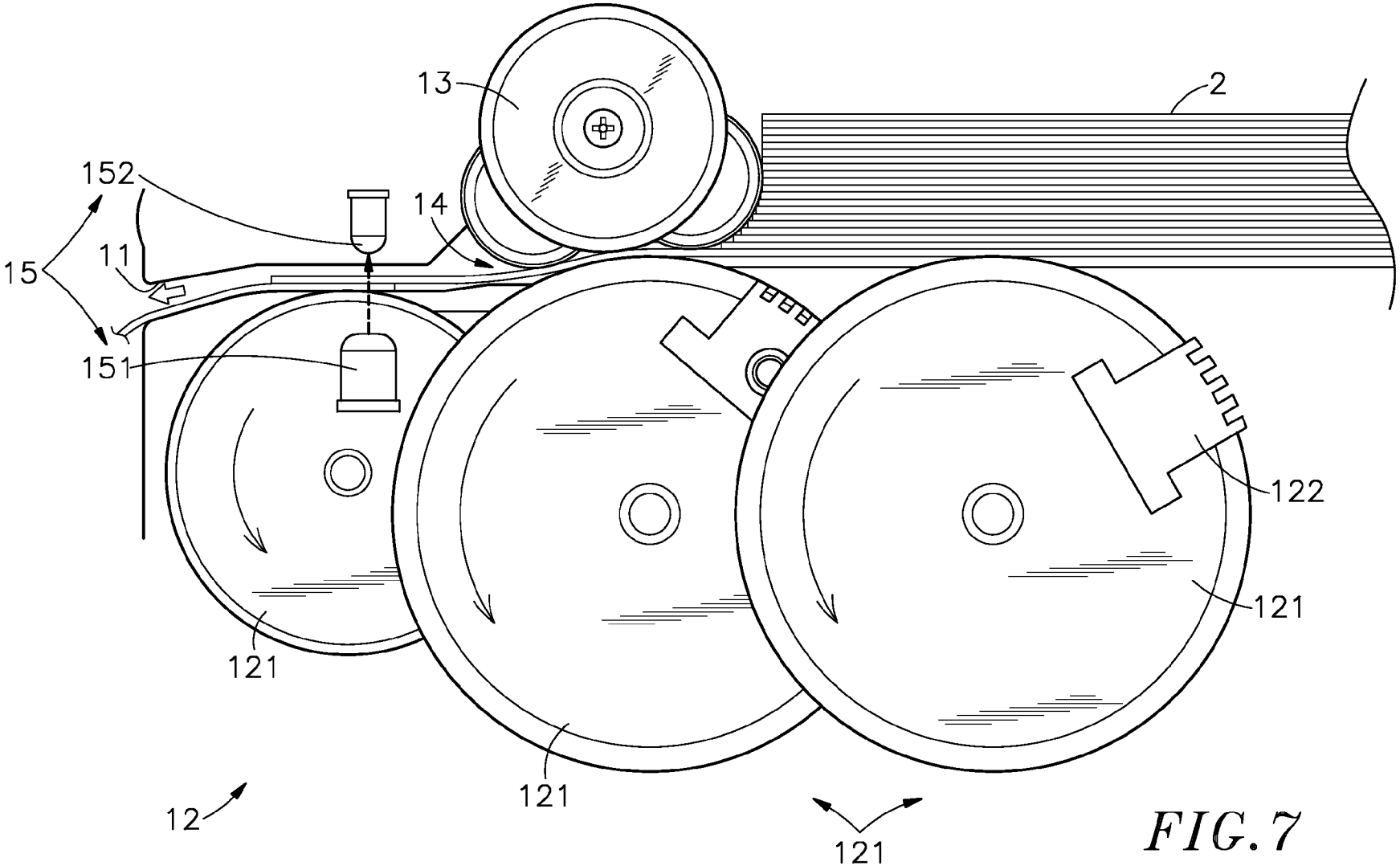
FIG. 7 is a schematic drawing showing the operation of the sheet member dispenser according to the present invention (IV).
Figure 8:
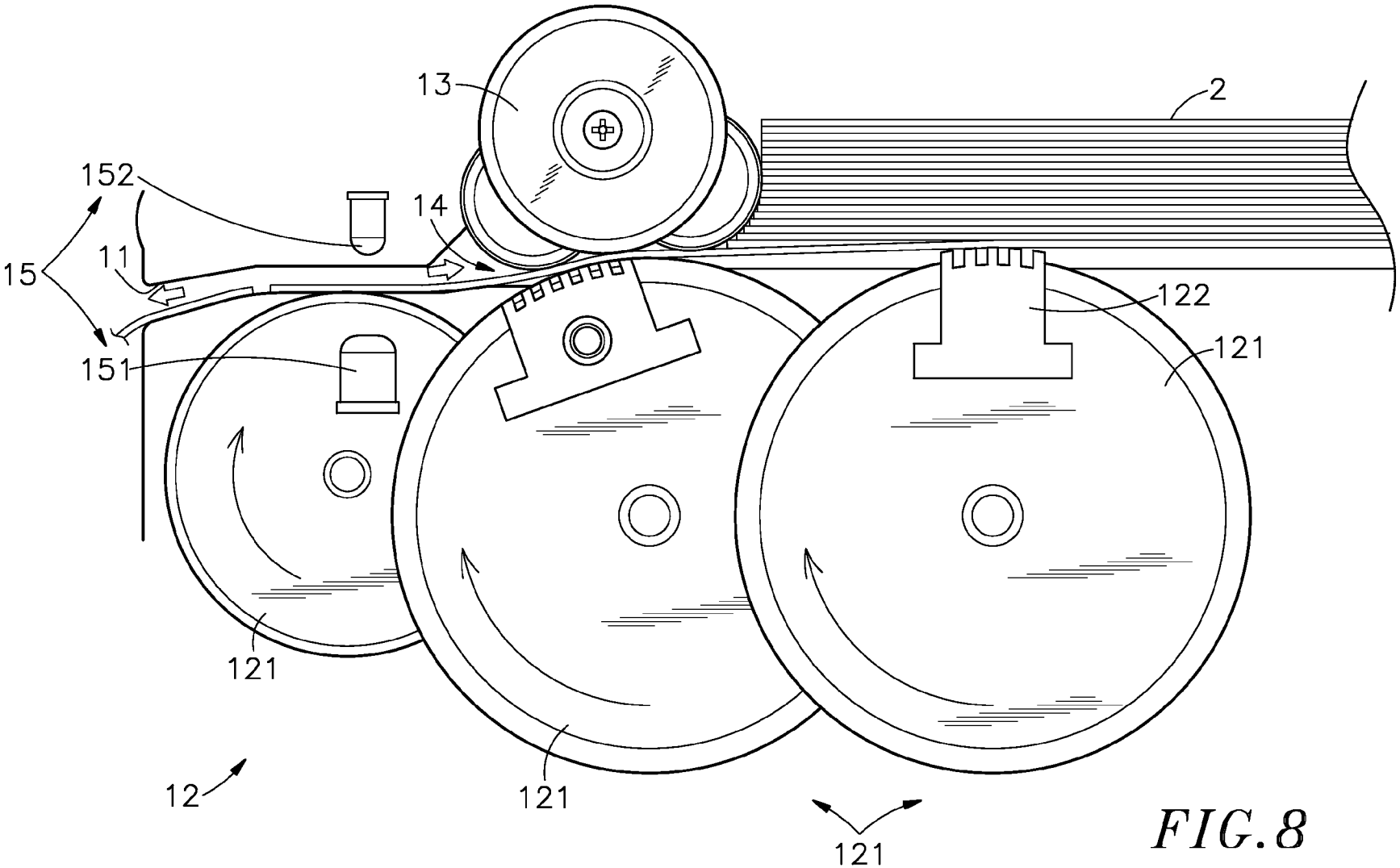
FIG. 8 is a schematic drawing showing the operation of the sheet member dispenser according to the present invention (V).
Figure 9:
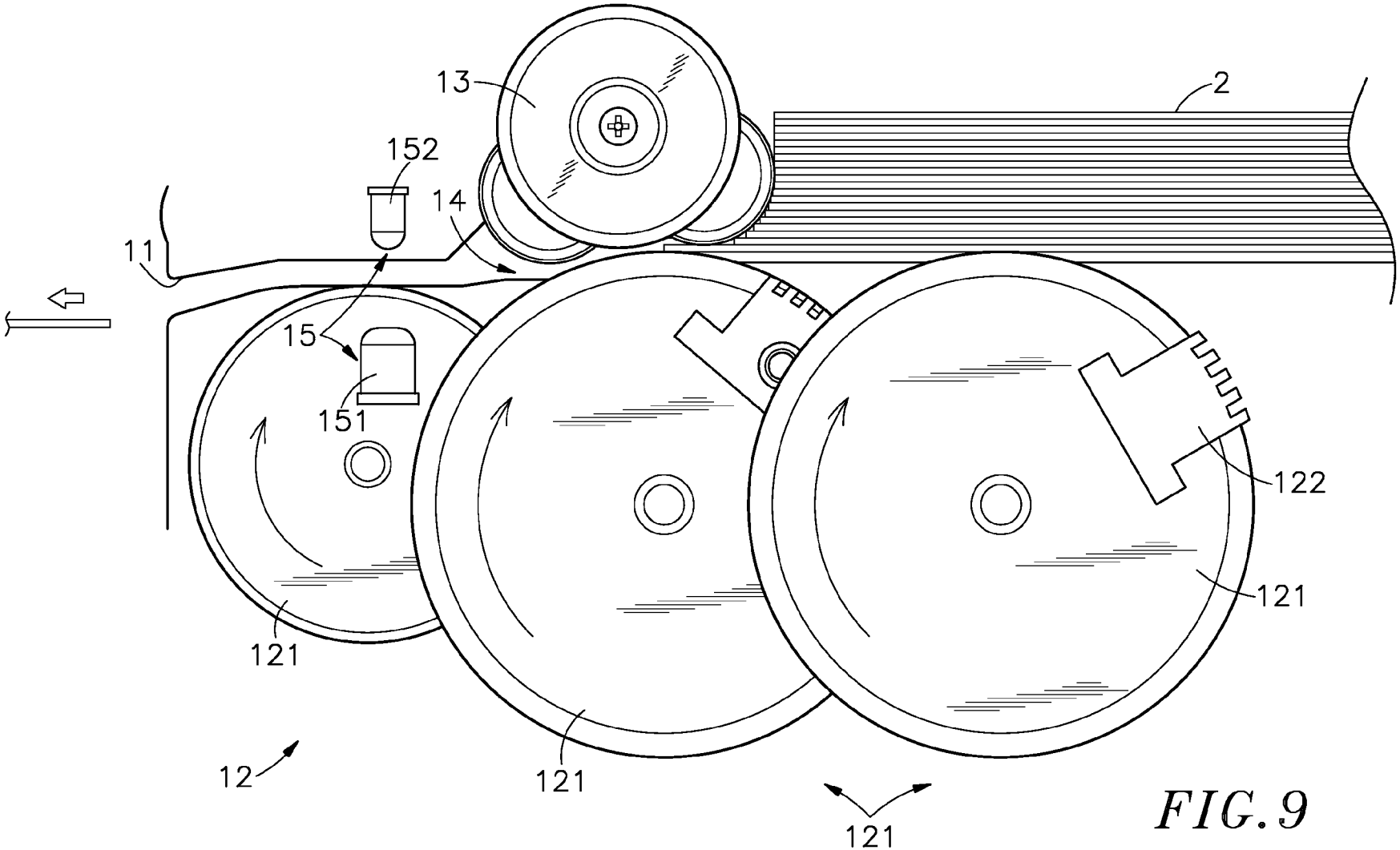
FIG. 9 is a schematic drawing showing the operation of the sheet member dispenser according to the present invention (VI).

Further, except the aforesaid dispensing of two stacked sheet members 2, a second sheet member 2 may be overlapped on a first sheet member 2 and delivered with the first sheet member 2 toward the sheet member outlet 11. When a second sheet member 2 is overlapped on a first sheet member 2 and delivered with the first sheet member 2 toward the sheet member outlet 11 (see FIG. 7), the sensor 15 detects the partial overlap status. At this time, the transferring roller set 12 keeps rotating forwards to deliver the first sheet member 2 to the sheet member outlet 11 (see FIG. 8), and then the transferring roller set 12 is revered to move the second sheet member 2 backwards (see FIG. 9), preventing output of the second sheet member 2 with the first sheet member 1. When the overlapped area of two sheet members 2 surpasses a predetermined range, the sheet member dispenser runs in the same manner as the condition where two stacked sheet members 2 are delivered. If the overlapped area of two sheet members 2 being delivered through the sheet member path 14 is below the set value, the transferring roller set 12 will be reversed to move the second sheet member 2 backwards immediately after output of the first sheet member 2 to the sheet member outlet 11.

Figure 10:
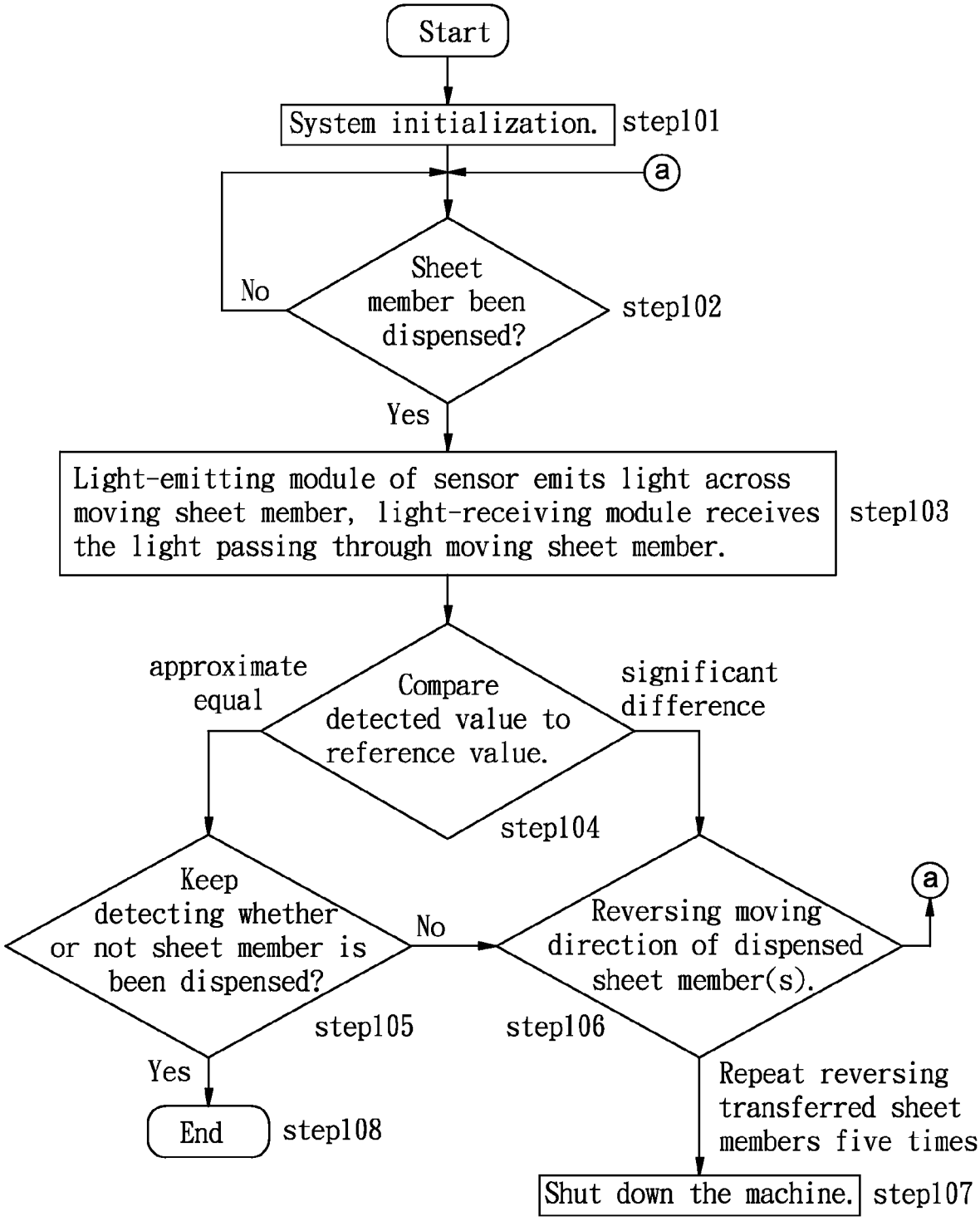
FIG. 10 is an operation flow chart of the present invention.
Figure 11:
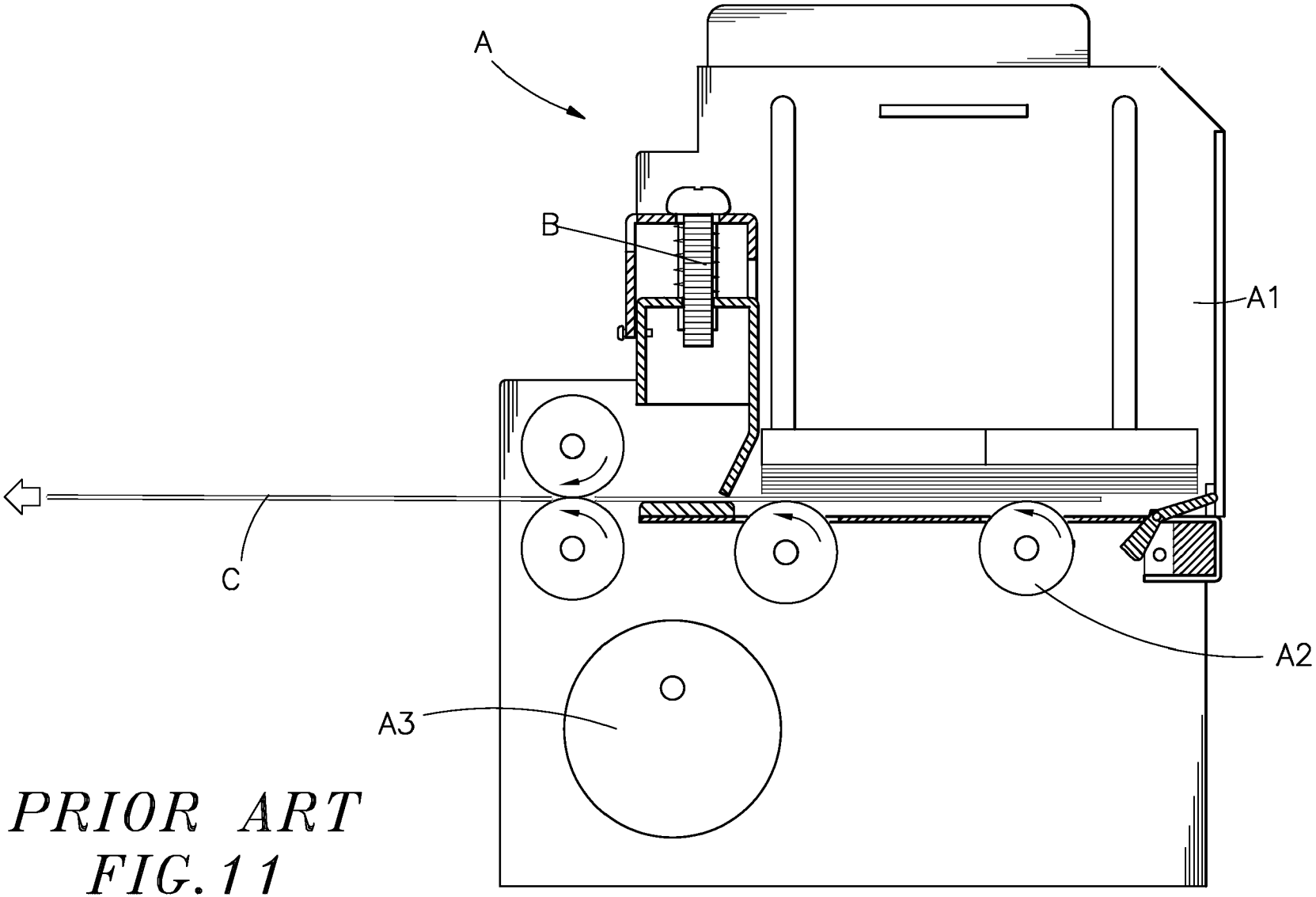
PRIOR ART FIG. 11
FIG. 11 is a schematic side view of a sheet member dispenser according to the prior art.

Referring to FIG. 10, during detection operation of the sensor 15, the invention runs the steps as follows:

(101) start system initialization;

(102) judge whether or not sheet member 2 is been dispensed?, and then proceed to step (103) when positive, or step (102) when negative;

(103) light-emitting module 151 of sensor 15 emits light across moving sheet member 2 toward light-receiving module 152, and light-receiving module 152 receives the light passing through moving sheet member 2, and then proceed to step (104);

(104) compare the transmittance thus detected to a predetermined reference value, and then proceed to step (105) if the difference of the comparison result is below a predetermined value, or step (106) if the difference of the comparison result surpasses a predetermined value;

(105) sensor 15 keeps detecting whether or not sheet member 2 is been dispensed?, and then proceed to step (108) if positive, or step (106) if negative (within a predetermined length of time);

(106) move transferred sheet member(s) 2 in the reversed direction and then return to step (102), or proceed to step (107) when transferred sheet members 2 have been reversed five times;

(107) shut down the machine, and inform the maintenance engineer to shoot the troubles;

(108) end.

As stated in the aforesaid operation flow chart, when two sheet members 2 are dispensed at the same time, the sensor 15 compares the transmittance of the light passing across the sheet members 2 to the reference value that is the transmittance of one individual sheet member 2, and the comparison result indicates the dispensing of two sheet members 2. When two sheet members 2 are stacked or overlapped and dispensed, the transferring roller set 12 is immediately reversed to move the second sheet member 2 backwards for further dispensing. By means of repeated forward and backward friction and dispensing, overlapped sheet members 2 can be separated and dispensed individually. If overlapped sheet members 2 still cannot be separated after the procedure of moving sheet members 2 backwards and dispensing them again has been repeated a predetermined number of times subject to the setting, the machine will be shut down for examination, preventing shutdown of the machine due to a false judgment. The number of times of repeating the procedure of moving sheet members 2 backwards and dispensing them again can be set subject to difference requirements. The aforesaid five times is simply an example for understanding of the present invention but not a limitation.

Further, the aforesaid reference value can be the transmittance of one single sheet member 2. Alternatively, the reference value can be the mean value of the transmittance of every individual one of a predetermined number of sheet members 2 been dispensed through the sheet member dispenser. The reference value is programmed in the setting program of the control circuit for comparison.

In general, the invention uses the sensor 15 to detect overlapped or stacked sheet members 2 during dispensing. Upon detection of overlapped or stacked sheet members 2, the transferring roller set 12 is immediately reversed to move overlapped or stacked sheet members 2 backwards for dispensing again. By means of repeated forward and backward friction and dispensing, overlapped or stacked sheet members 2 can be separated and dispensed individually. If overlapped or stacked sheet members 2 still cannot be separated after the procedure of moving overlapped or stacked sheet members 2 backwards and dispensing them again has been repeated a predetermined number of times subject to the setting, the transferring roller set 12 will move the overlapped or stacked sheet members 2 backwards and then the machine will be shut down for examination, preventing shutdown of the machine upon one false judgment. Further, the sheet members 2 according to the present invention can be banknotes, tickets, coupons, etc.

A prototype of individual sheet member output control method has been constructed with the features of FIGS. 1~10. The individual sheet member output control method functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An individual sheet member output control method used in a sheet member dispenser comprising a housing, which accommodates a stack of sheet members and has a sheet member outlet and a sheet member path for guiding said sheet members to said sheet member outlet, a transferring roller set adapted to transfer sheet members forwards to said sheet member path, a dispensing roller set disposed at a top side of said sheet member path and adapted to dispense sheet members from said transferring roller set to said sheet member outlet, and sensor means provided between said dispensing roller set and said sheet member outlet, the individual sheet member output control method comprising the steps of:

(A) said sensor means judging whether or not overlapped sheet members have been dispensed;

(B) when said sensor means judges that overlapped sheet members have been dispensed, reversing said transferring roller set to move overlapped sheet members backwards wherein an overlapped area is above a predetermined value and then rotating said dispensing roller set forwards to re-dispense the overlapped sheet members;

(C) when said sensor means judges that overlapped sheet members are again dispensed after a secondary dispensing by said dispensing roller set, reversing said transferring roller set to move the overlapped sheet members backwards again, wherein said overlapped area is above said predetermined value and then rotating said dispensing roller set forwards to re-dispense the overlapped sheet members again;

(D) reversing said transferring roller set to move the overlapped sheet members backwards and shut down said sheet member dispenser after step (C) has been repeated a predetermined number of times;

(E) if said overlapped area of overlapped sheet members is below said predetermined value, rotating said transferring roller set forwards to deliver the overlapped sheet members toward said sheet member outlet and then reversing said transferring roller set to move the second sheet member backwards after the first sheet member has been moved out of said sheet member outlet.

2. The individual sheet member output control method as claimed in claim 1, wherein said transferring roller set is comprised of a plurality of transferring rollers, and at least one push block affixed to at least one of said transferring rollers for rubbing against one of said sheet members to move the sheet member forwards.

3. The individual sheet member output control method as claimed in claim 1, wherein said sensor means comprises a light-emitting module and a light-receiving module arranged at two sides of said sheet member path and aimed at each other.

4. The individual sheet member output control method as claimed in claim 3, wherein said light-emitting module is adapted to emit light across the sheet member being dispensed into said sheet member path toward said sheet member outlet by said dispensing roller set; said light-receiving module is adapted to receive the light passing across the sheet member being moved through said sheet member path toward said sheet member outlet and to compare the transmittance of the light passing across the sheet member being moved through said sheet member path toward said sheet member outlet to a reference value.

5. The individual sheet member output control method as claimed in claim 4, wherein said reference value is the mean value of the transmittance of every individual one of a predetermined number of sheet members been dispensed out of said sheet member outlet by said dispensing roller set.

* * * * *